US006748874B2

(12) United States Patent
Gawronski

(10) Patent No.: US 6,748,874 B2
(45) Date of Patent: Jun. 15, 2004

(54) SHELF FOR REMOVABLE ATTACHMENT TO SUPPORT

(76) Inventor: Jeffrey Stephen Gawronski, 245 Oxford Rd., Apt. 4-D, New Hartford, NY (US) 13413

( * ) Notice: Subject to any disclaimer, the term of this patent is extended or adjusted under 35 U.S.C. 154(b) by 0 days.

(21) Appl. No.: 10/288,181

(22) Filed: Nov. 5, 2002

(65) Prior Publication Data

US 2004/0083931 A1 May 6, 2004

(51) Int. Cl.[7] ..... A47B 23/00

(52) U.S. Cl. ..... 108/42; 108/152; 108/49; 248/248.4

(58) Field of Search ..... 108/49, 42, 152, 108/147.11, 147.12, 147.13, 147.5, 108; 248/218.4, 219.1

(56) References Cited

U.S. PATENT DOCUMENTS

| | | | | | |
|---|---|---|---|---|---|
| 2,920,853 | A | * | 1/1960 | Bufogle | 108/49 |
| 3,181,485 | A | * | 5/1965 | Dotson et al. | 108/152 |
| 3,680,235 | A | * | 8/1972 | Leemhuis | 108/152 |
| 3,822,847 | A | * | 7/1974 | Emmons | 108/152 |
| 4,311,101 | A | * | 1/1982 | de Almagro | 108/152 |
| 4,836,113 | A | * | 6/1989 | Waddell et al. | 108/49 |
| 4,861,102 | A | * | 8/1989 | Fuller | 108/49 |
| 5,282,427 | A | * | 2/1994 | Steinhilber | 108/152 |
| 5,359,741 | A | * | 11/1994 | Lang | 108/49 |
| 5,647,075 | A | * | 7/1997 | Perkins | 108/49 |
| 6,474,244 | B1 | * | 11/2002 | Karpinski | 108/42 |

FOREIGN PATENT DOCUMENTS

| | | |
|---|---|---|
| EP | 206994 | * 12/1986 |

* cited by examiner

*Primary Examiner*—Jose V. Chen
(74) *Attorney, Agent, or Firm*—Donald Grant Kelly

(57) ABSTRACT

A shelf for attachment to the bedposts of wooden or metal bunk beds, although it may also be attached to the headboards of these type beds. The shelf is best molded of a plastic such as ABS, including an integrally molded perpendicular mounting angle frame for attachment to a clamping device also of plastic. The shelf surface may have a hole, groove or depression for supporting a cup, beverage can, writing instrument or such. Adequate space on the surface is provided to support a small radio, clock or book of minimal weight. The shelf attachment device includes plastic clamps located within channels of the mounting angle frame. Bolts with locking knobs allow tightening of the clamps in position against the bedpost.

20 Claims, 9 Drawing Sheets

SHELF FOR REMOVABLE ATTACHMENT TO SUPPORT

FIELD OF THE INVENTION

This invention relates in general to shelving, and more particularly to a small shelf and means for affixing it, so as to extend outward, from the posts of a bunk bed, i.e., two platform beds, one above the other.

BACKGROUND

Typically, one such shelf would be fixed to the upper part of the bedpost or the headboard to service the person in the upper berth having no easy access to a nightstand placed on the floor of the room. Of course one could also use the instant invention on the lower part of the bedpost for use in dormitories or small rooms with little available space for a nightstand. Furthermore, the invention can also be used on both the upper and lower parts of the posts at the same time if desired. Such an invention is quite suitable, for example, for holding an alarm clock, a book, small radio or drinking glass, eyeglasses, remote controls, pens and the like so long as they do not exceed approximately five or six pounds in total weight.

It is anticipated that the instant invention will find most use anywhere bunk beds are common: in military or military school barracks, in college dormitories, in summer camp residences, in homes with young and teen-age children, and even in a prison environment. The concept of this invention is such that it would neither find effective use for writing or dining thereon nor is it the intention to do so, both functions may be considered to be relatively aggressive for such a small shelf.

The prior art reveals a number of trays for attachment to the bedrails or headboards of a bedstead, none appear to involve attachment to bedposts. Most of these utility patents are of a type capable of supporting heavy trays, substantial enough for eating therefrom and/or writing thereon, typical of those associated with hospital beds. U.S. Pat. No. 1,894,991 issued to J. H. Hayes provides a tray and connections to a headboard so that the tray may be readily moved to various positions to be conveniently and comfortably used as a reading desk or a dining tray or the like. U.S. Pat. No. 1,256,498 issued to J. P. Baker embodies a tray attached toga bedrail and sturdy enough for similar use. U.S. Pat. No. 3,054,122 issued to P. G. Sarkus and another issued to N. T. Sarkus, U.S. Pat. No. 3,118,399 provide a combined bed tray and nightstand attachment which is longitudinally adjustable with respect to a bed and which may be pivotally moved. Roberts was issued a design U.S. Pat. Design No. 243,049 for a portable shelf for a telephone or similar article having a shelf tiltable to permit more comfortable reading.

It is the main object of the instant invention to provide a small and lightweight shelf for holding small objects on the post of a bunk bed.

It is a further object that this shelf have a simple means for attachment to and removal from the post as well as for movement up or down; as well for attachment to the headboard of the bed, where possible, and for movement back and forth.

It is an additional object that the flat surface of the shelf have a slot therein for holding, for example a pen or pencil so as not to allow them to fall off when the entire bed is shaken as when a person is getting in or out of the bed.

Another object is for the upper surface of the shelf to have a hole or depression therein for supporting a glass or cup.

It is another object that there be available space thereon for supporting a clock, small radio, book or any other object small in size and weighing less than 5 or 6 pounds.

It is a further object of the instant invention that the design and manufacture be simple and of low cost

SUMMARY OF THE INVENTION

A device for attachment to the bedpost of bunk beds for holding items thereon comprising: a shelf; a pair of support ribs integral with the underside of the shelf and extending perpendicularly therefrom at the one end thereof forming a mounting angle frame, said frame having a slot therein for slidably receiving an adjustment screw; and a pair of slidable clamping angles for insertion into a channel of said mounting frame. The outward facing end of the shelf is rounded to prevent injury, and having a hole or depression in the surface thereof for holding a glass, cup or beverage container for preventing spillage therefrom in the event of being shaken, and having a groove in the surface thereof for preventing a writing instrument therein from falling off.

The shelf and said mounting frame being of one integrated piece molded of a suitable thermoplastic resin and being capable of placement up and down on said bedpost, and capable of placement back and forth on a head board where feasible. This device further comprises protective pads attached to said clamps and said mounting angle frame for preventing damage to the bedpost. The device of the invention further comprising bolts having hex heads and male threaded shafts, said hex heads for locking into captive holders of said clamping angles while said threaded shafts go through said slot into the female threaded portion of locking knobs for tightening said clamping angles against said bedpost.

BRIEF DESCRIPTION OF THE DRAWINGS

The above and other objects, features and advantages of the present invention will be more clearly understood from the following detailed descriptions of what are considered to be the preferred form of the invention taken in conjunction with the accompanying drawings, in which.

DESCRIPTION OF THE PREFERRED EMBODIMENTS

Figure 1:
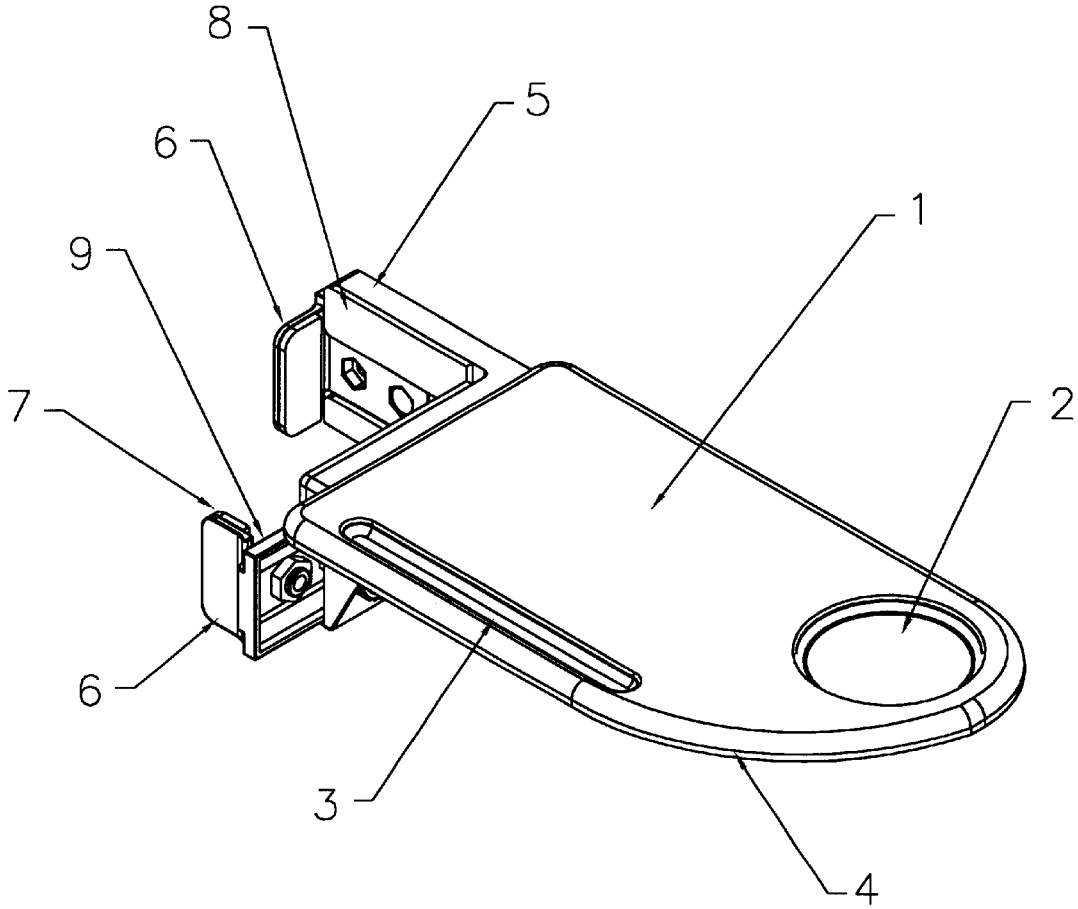
FIG. 1 is a perspective view of a shelf constructed in accordance with this invention showing thee shelf with a partial view of its clamp attached.

For the purposes of presentation, FIG. 1 is a perspective view of a shelf constructed in accordance with this invention showing the top of the shelf 1 with a partial view of its attached slidable clamps 6. Shelf 1 and clamps, 6 are both molded preferably from ABS, or Acrylonityile Butadiene Styrene, although other suitable material could also be utilized. Shelf top 1 has a hole or depression 2 therein to allow for placement of a glass, cup, or beverage can to avoid spillage in the not uncommon event when such a bed is shaken. A groove 3 for placement of a pen or pencil is also shown. The front end of 4 of shelf 1 is rounded to avoid injury otherwise common with sharp edges. Integral with molded shelf 1 is mounting angle frame 5 for supporting molded clamps 6 when slid into channels 9 (not shown) of angle frame 5 for providing a tight fit around bedpost 11 shown in the next figure. It should be noted that both clamps 6 have protective pads 7 to protect both the clamps and the bedpost. Similarly, mounting angle frame 5 has protective pads 8 to protect bedpost 11. It should be pointed out that while angle frame 5 and clamps 6 have been specifically designed for use with the conventional square-shaped wooden bedposts of a bunk bed, they also work well for metal bunk beds having pipe bedposts. However, a simple adaptor (not shown) attached to the upper part of the clamps 6 and allowed to hang down will fill any gap and provide equivalent performance in a metal pipe system.

Figure 2:
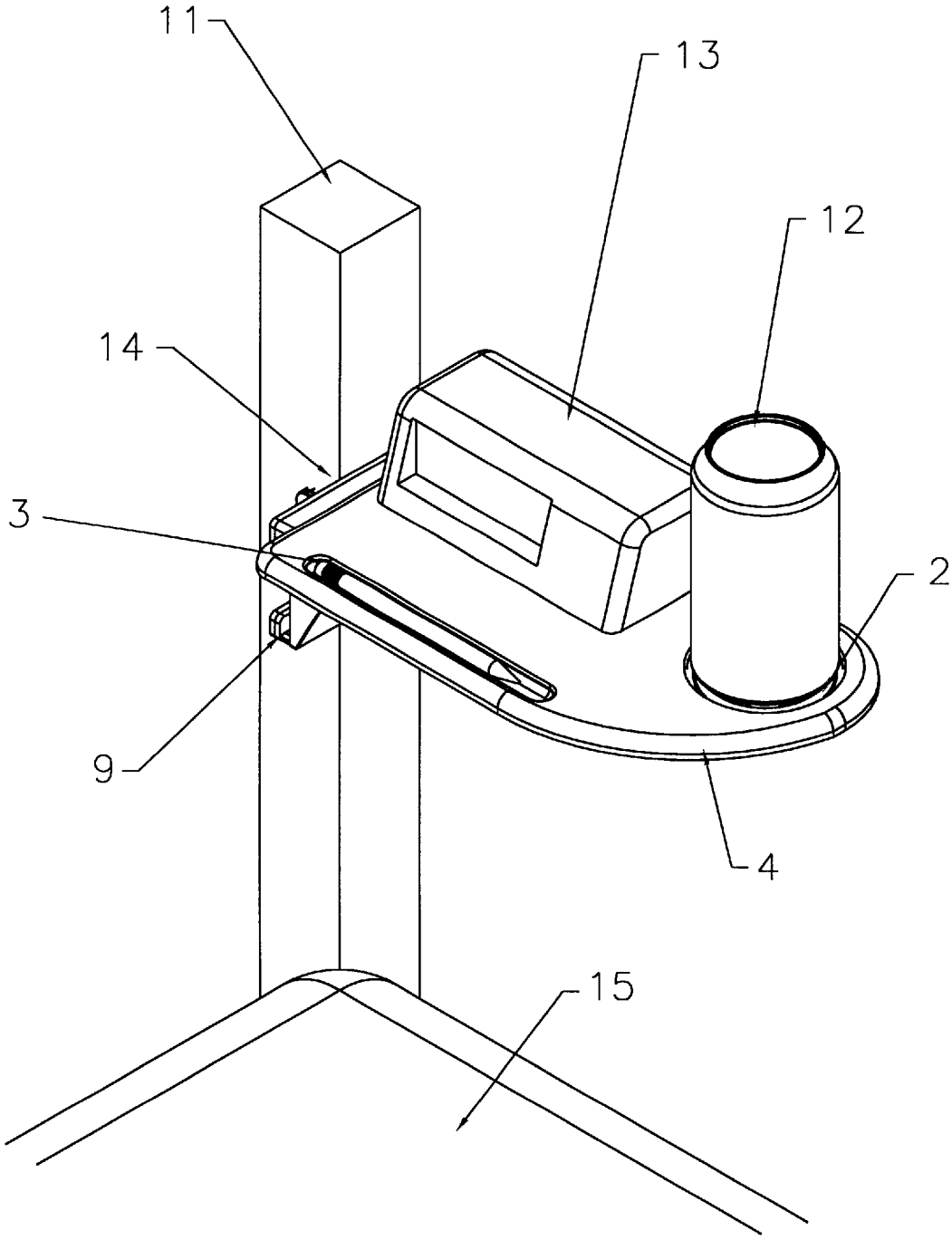
FIG. 2 is a perspective view showing the shelf attached to a bedpost, in use with objects thereon.

FIG. 2 shows shelf 1 attached to bedpost 11 in use with objects thereon. Typical objects shown are a soda can 12, a clock 13, and a pencil in groove 3. Instead of a clock, this space might be used for a small radio, or a book, or whatever weighing less than 5 or 6 pounds. While 14 indicates a tight mounting surface to bedpost 11, this is merely for illustrative purposes since the clamps are not shown; however, channel 9 into which clamps 6 slide is clearly visible. Mattress 15 is also depicted.

Figure 3:
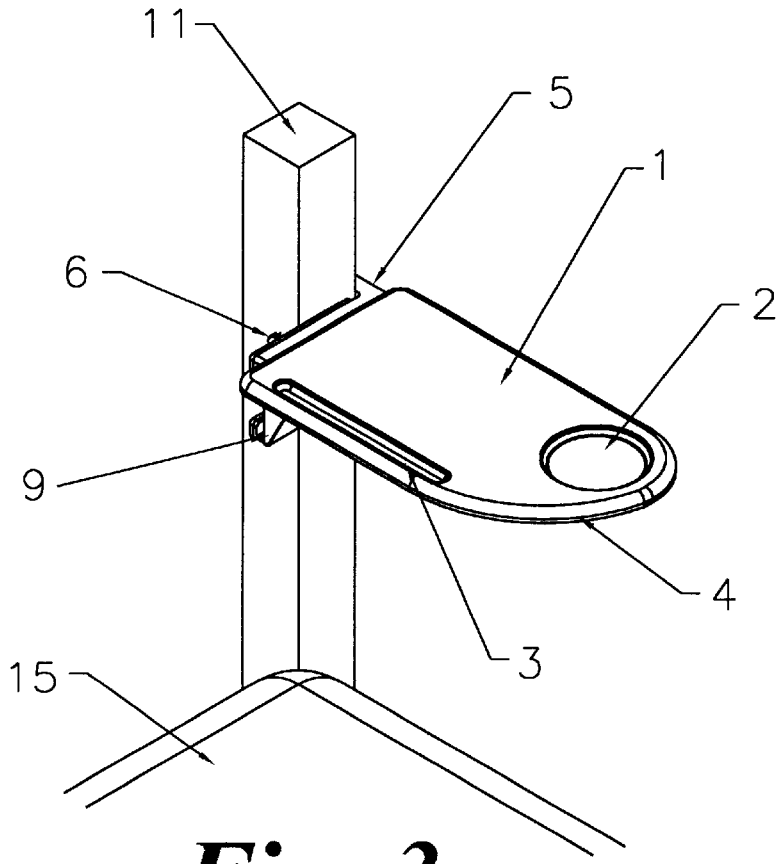
FIG. 3 is a perspective view showing the empty shelf attached to a bedpost.
Figure 4:
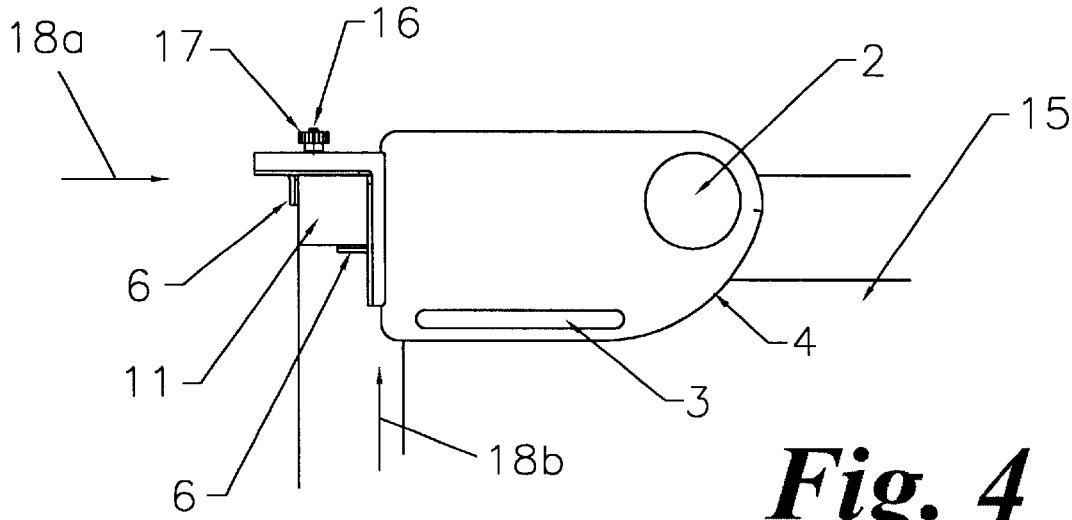
FIG. 4 is a top view of the empty shelf and its clamp mounted on a square (or rectangular) bedpost.

While FIG. 3 merely illustrates the empty shelf version of FIG. 2, FIG. 4 illustrates a top view of FIG. 3 clearly showing the clamping method of the invention. Direction 18A shows the direction of movement of one clamp 6 into close proximity to bedpost 11, while 18B shows the direction of movement of the other clamp 6. Locking knob 17 is internally threaded so as to screw down on hex-headed bolt 16 having a threaded shaft for interaction with knob 17 thereby providing the tightening necessary to secure shelf 1 to bedpost 11; this is illustrated more clearly below.

Figure 5:
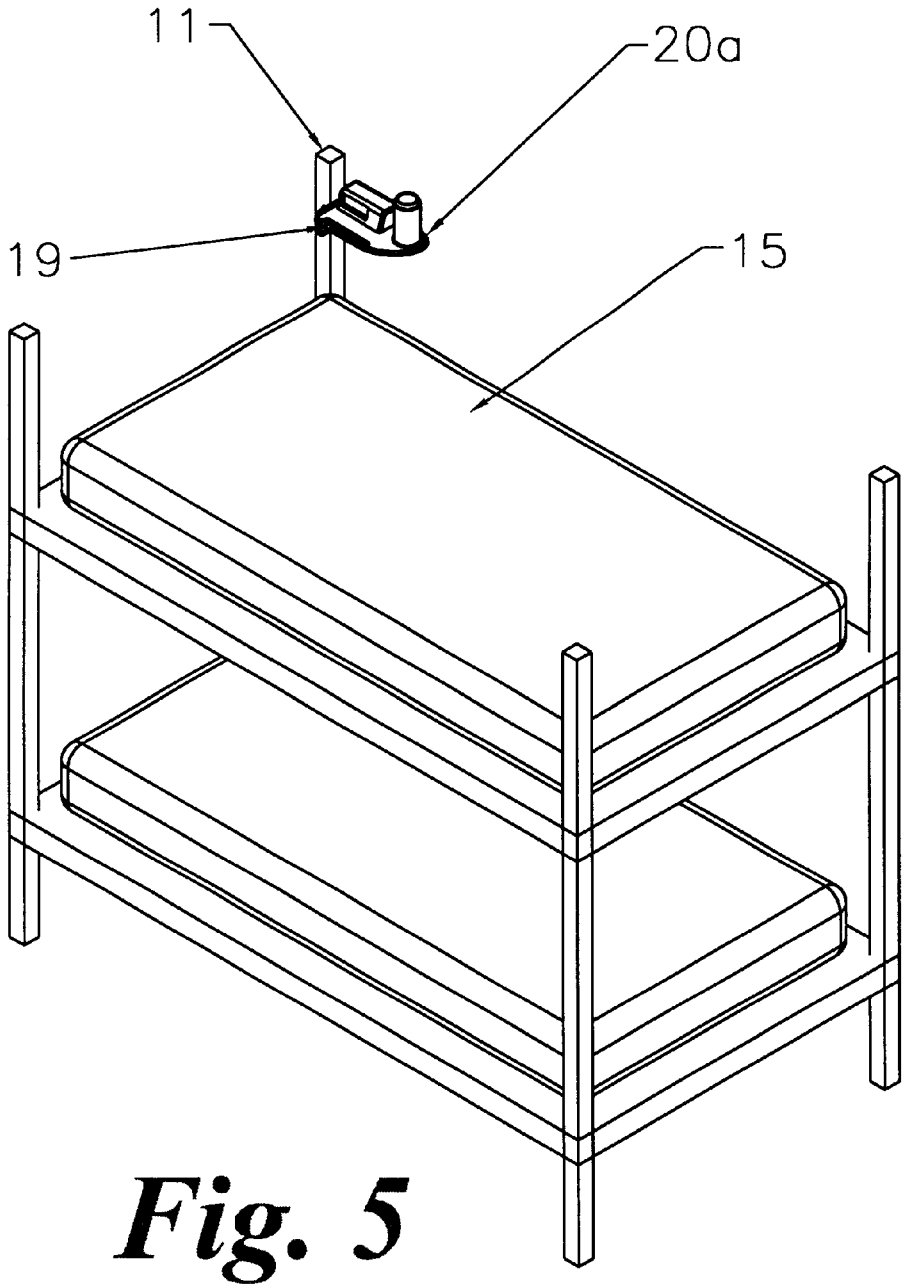
FIG. 5 is a perspective view from afar of the shelf in use mounted to the bedpost of a bunk bed.
Figure 6:
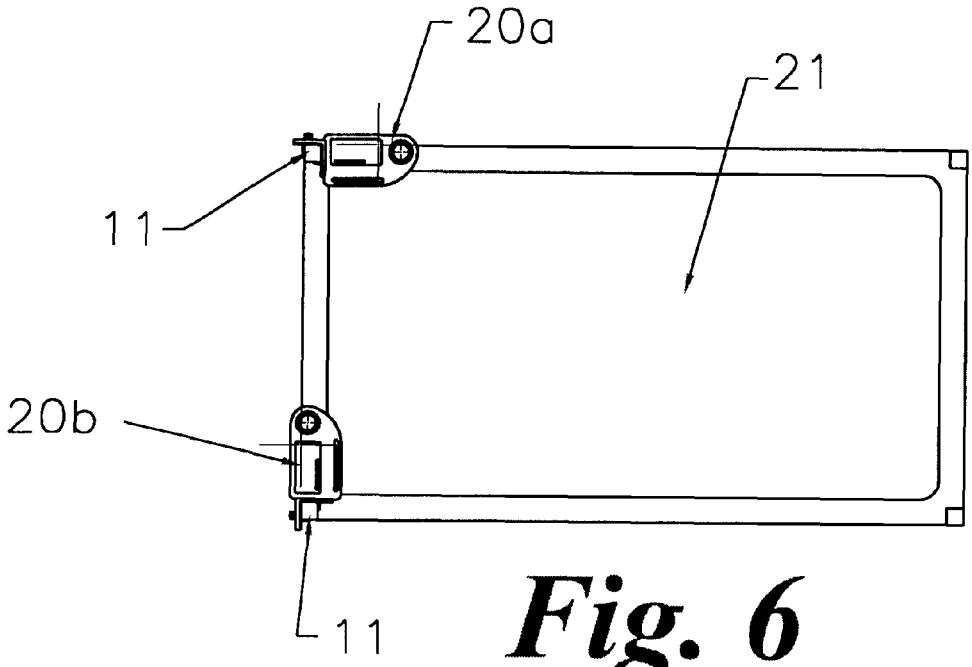
FIG. 6 is a top view of two shelves on the layout of a bunk bed simultaneously mounted, the one along a side of the bed and the other across the head of a bed.
Figure 7:
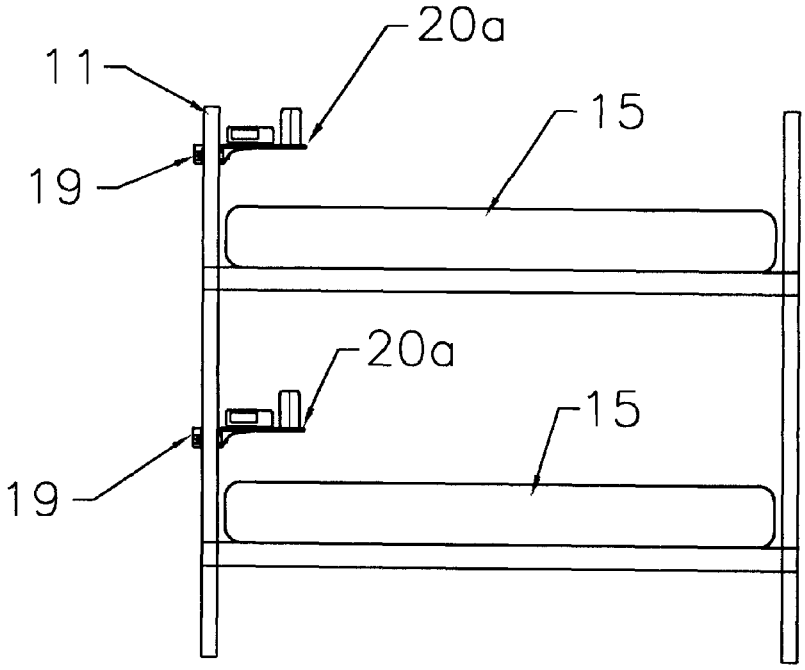
FIG. 7 is a side view showing the layout of two shelves attached to the bed, one for the top bed and the other for the bottom bed.
Figure 8:
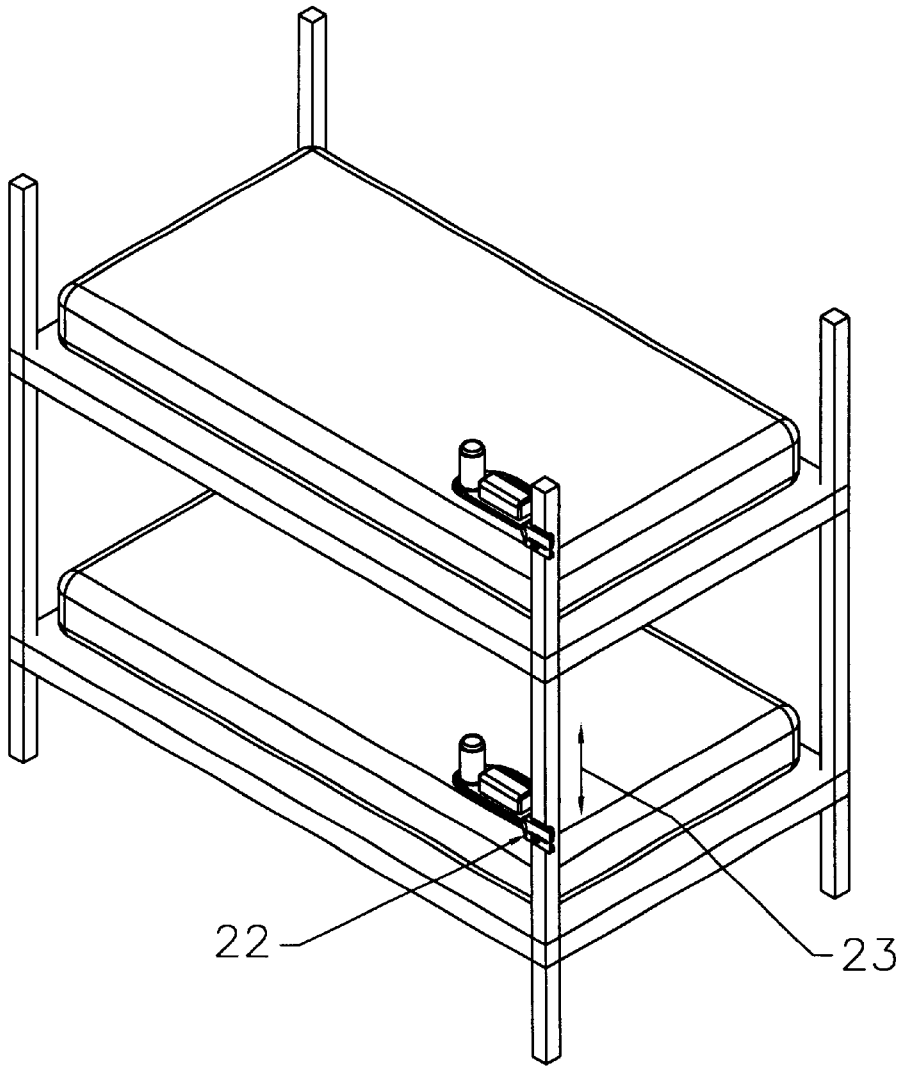
FIG. 8 is a perspective view of the upper and lower shelves shown mounted from the back side and illustrating the possible adjustments of the clamp to provide a comfortable height for the user.

FIGS. 5, 6, 7 and 8 illustrate the various positions the bedpost shelf of this invention can be placed with respect to mattress 15 and bed 21. In FIG. 5 clamp assembly 19 mounts shelf 20*a* with items thereon onto bedpost 11 along side of bed 21; whereas in FIG. 6 shelf 20*a* is mounted along the side of the bed, while shelf 20*b* is mounted across the head of the bed. FIG. 7 is a side view showing the layout of two shelves attached to the bed, one for the top bed and the other for the bottom bed. FIG. 8 meanwhile, is a perspective view of the upper and lower shelves shown mounted from the back side and illustrating the possible adjustments of the clamp angle 22 having been slid in to create a tight fit and then screwed down to lock in place to provide an adjustable height 23 for the comfort of the user.

Figure 9A:
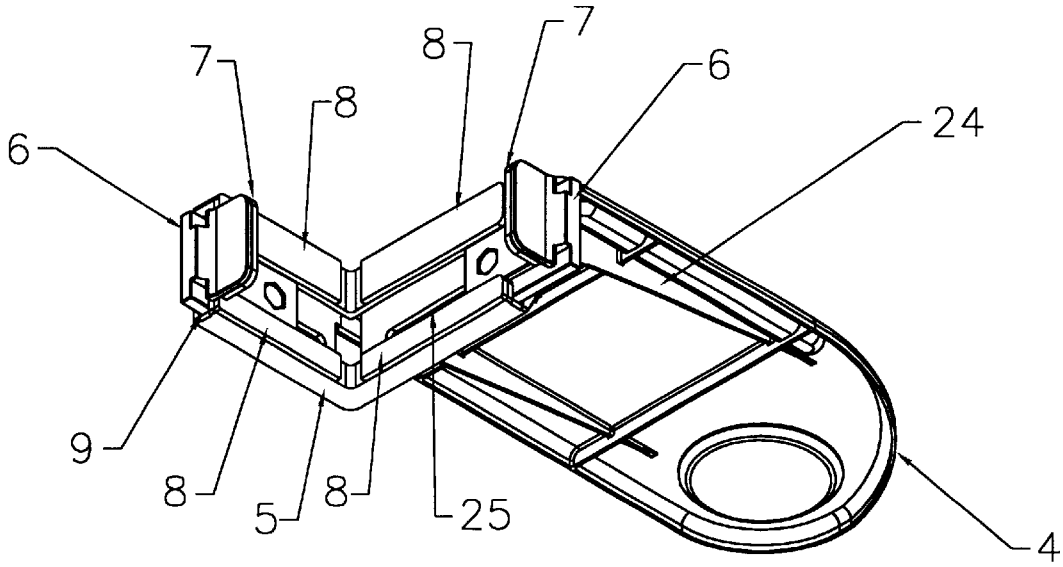
FIG. 9*a* is a perspective view of the back underside of the shelf and clamp attached showing detail of the clamp and the support ribs of the shelf.
Figure 9B:
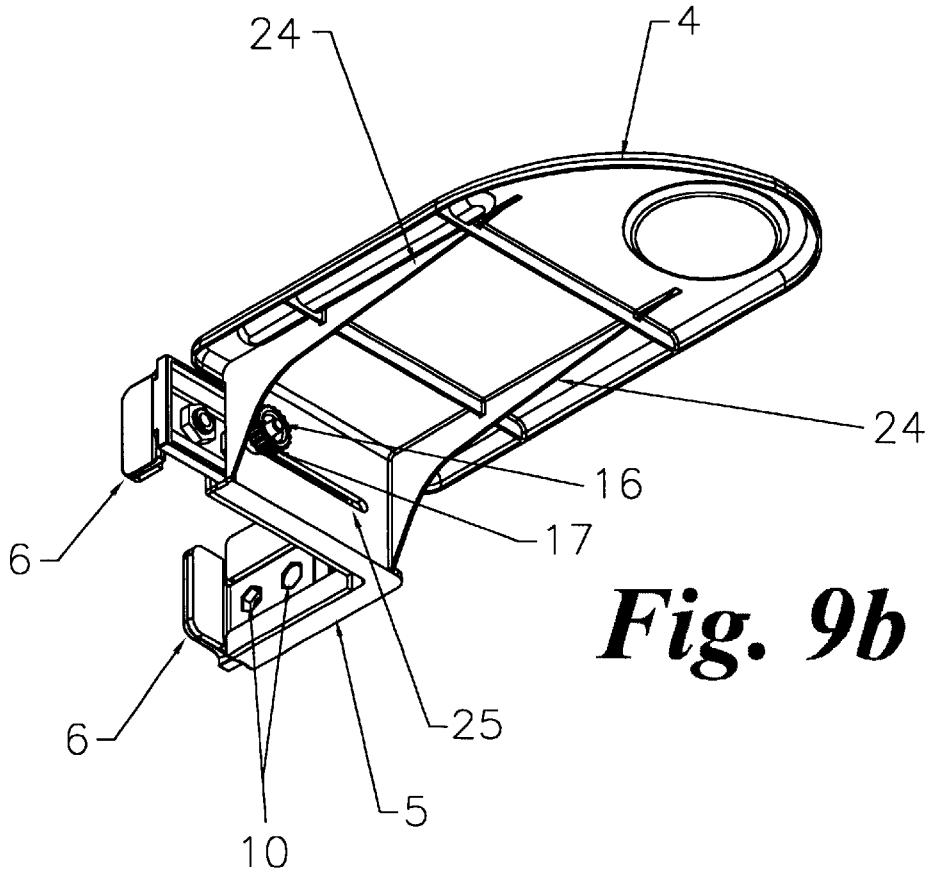
FIG. 9*b* is a front underside perspective view of 9*a* from a different angle illustrating further clamp detail.

FIG. 9*a* is a perspective view of the back underside of shelf 1 and clamp 6 attached showing detail of clamp 6 and support ribs 24 of the shelf. The adjustment slot 25 of mounting frame 5 permits the position of bolt 16 to be adjusted as shown in FIG. 9*b*. Captive holder 10 for the heads of hex bolt 16 is shown on 1" centers. Holder 10 engages the hex head of bolt 16 thereby holding it in place as the threaded shaft of 16 goes through slot 25 to mate with the internal threads of locking knob 17 thereby clamping angle 6 against bedpost 11. FIG. 9*b* is a front underside perspective view of 9*a* from a different angle illustrating further clamp detail.

Figure 10A:
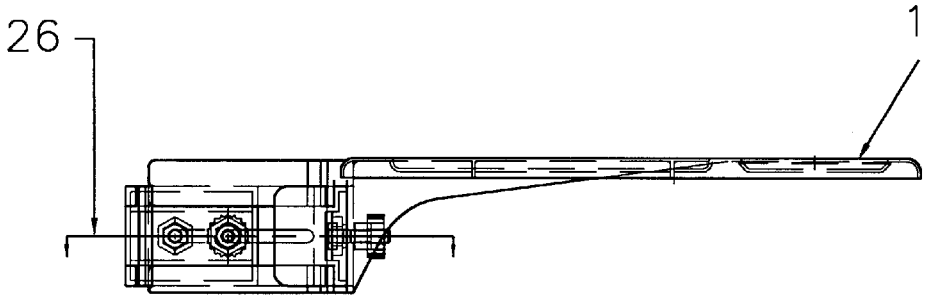
FIG. 10*a* is a sectional side view of the shelf with clamp attached illustrating the bolt locking mechanism.
Figure 10B:
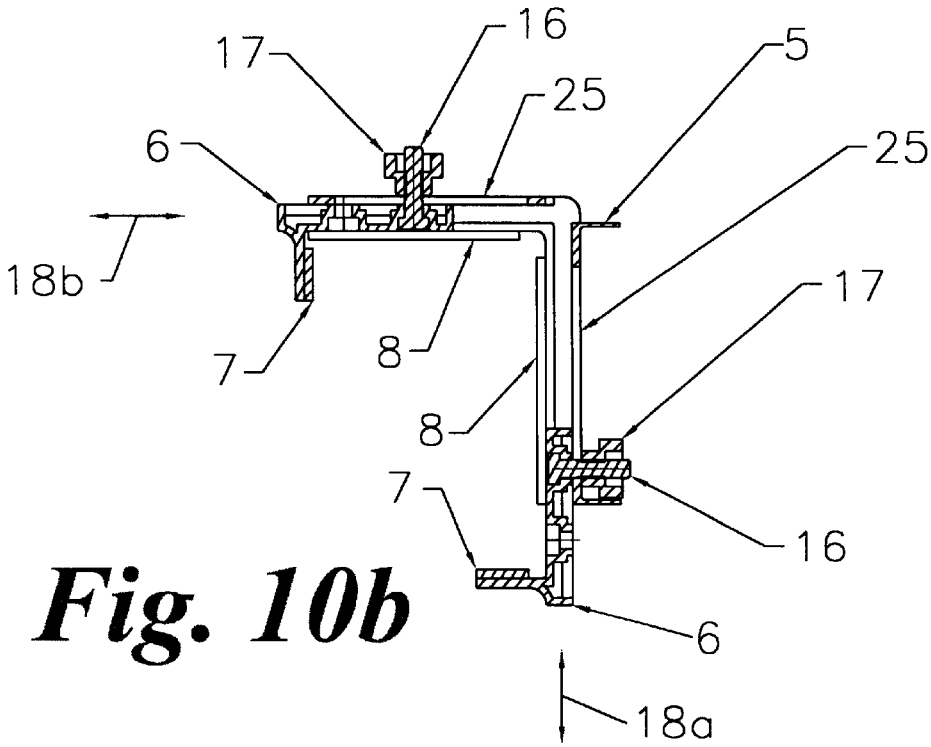
FIG. 10*b* is a sectional top view of the clamping area of the shelf illustrating directional movement of the clamps.

FIG. 10*a* is a sectional side view 26 of shelf 1 with clamp 6 attached illustrating the bolt locking mechanism. FIG. 10*b* is a sectional top view of the clamping area of the shelf wherein 18*a* and 18*b* illustrate directional movement of the clamps and their locking mechanisms.

Figure 11:
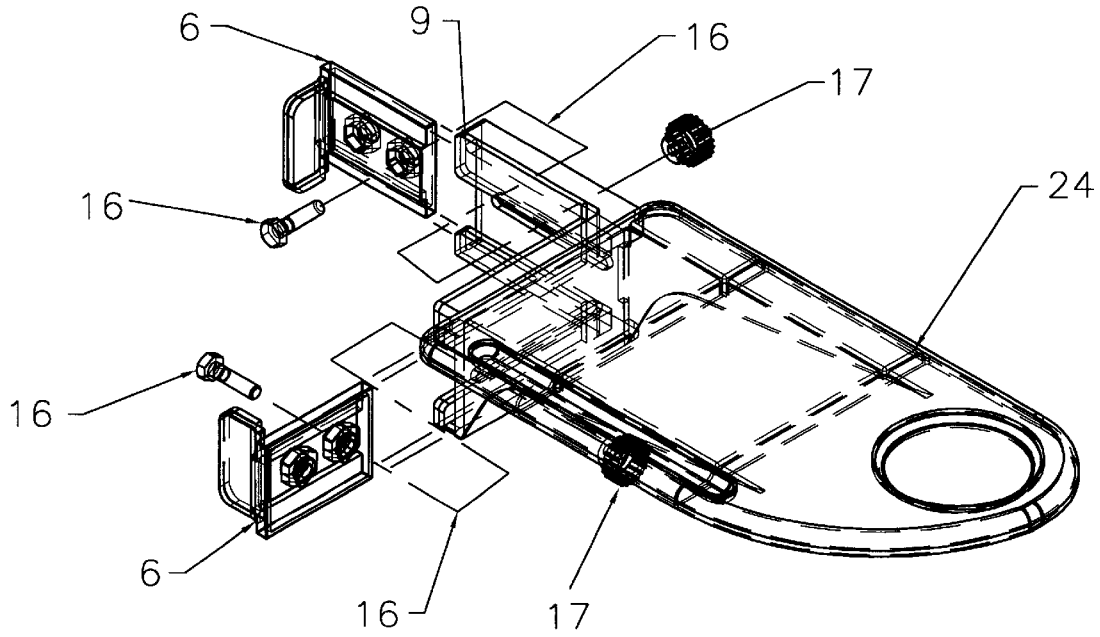
FIG. 11 is an exploded view of the underside of the shelf illustrating how a bolt goes through the clamp and the slot to join with the locking knob thereby allowing tightening of the internal thread of the knob with the external thread of the bolt.

FIG. 11 is an exploded view of the underside of the shelf illustrating how bolt 16 goes through clamp 6 then through slot 25 to join with locking knob 17 thereby allowing tightening of the internal thread of knob 17 with the external thread of bolt 16.

Installation of the device of the invention against a bedpost involves the following simple steps:

1. The mounting frame with its channels already holding the clamps is positioned in close contact with the bedpost in the desired location;
2. each of the two bolts is pushed through one of the hex-shaped holes in the clamps on either side (the hex-shaped hole chosen depends on the thickness of the bedpost) so that the bolt heads are retained in the holes while the male threaded shafts go through the slots and make contact with, the female threaded knobs; subsequent tightening of the knobs clamps the device against the bedpost on two adjoining sides thereof.

Thus, the objects of this invention have been achieved in that not only has the design and manufacture of the device at low cost been realized, but thee means for attachment to and removal from the post as well as for movement up or down has been accomplished in a very simple manner.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A device for attachment to a bedpost for holding items thereon comprising:

a shelf;

said shelf including at least one support rib;

said shelf and said at least one support rib forming at one end thereof a mounting angle frame extending substantially perpendicular to said shelf at said one end;

said shelf, said mounting angle frame, and said at least one support rib being of one integrated, molded piece;

said mounting angle frame including channels;

said mounting angle frame further including at least one slot therein for slidably receiving an adjustment bolt;

an adjustment bolt slidably received in each said slot;

a pair of slidable clamping angles adapted for insertion into said mounting angle frame channels;

whereby said integrated molded piece, including said at least said one support rib and mounting angle frame, is placed adjacent said bedpost so that said mounting angle frame abuts said bedpost such that said adjustment bolt in said slot acts to tighten said clamping angles against said bedpost.

2. The shelf of claim 1 whose outward facing end is rounded to prevent injury, and having a hole in the surface thereof for holding a glass, cup or beverage container for preventing spillage therefrom in the event of being shaken, and having a groove in the surface thereof for preventing a writing instrument therein from falling off.

3. The shelf, said rib, and said mounting frame of claim 1 being of one integrated piece molded of a suitable thermoplastic resin and being capable of placement up and down on said bedpost, and capable of placement back and forth on a head board.

4. The device of claim 1 further comprising protective pads attached to said slidable clamping angles and said mounting angle frame for preventing damage to the bedpost.

5. The device of claim 1 wherein each adjustment bolt is further provided a captive holder located on said clamping angle and a locking knob;

each said bolt having a hex head and male threaded shaft;

each said locking knob having a female threaded portion;

said hex head adapted for locking into said captive holder of each of said clamping angles while said bolt threaded shaft goes through said slot into the female threaded portion of said locking knob for tightening said clamping angles against the bedpost.

6. A device of the type adapted to support items and to be adjustably attached to and removed from a post, including a shelf having a substantially flat upper surface and an underside, the improvement comprising:

said shelf including at least one support rib located at said underside and extending along said underside toward one end of said shelf;

said rib and said shelf forming at said one end thereof an angle frame;

said shelf and said at least one support rib being of one integrated piece molded to also include said angle frame;

said angle frame further including clamps slidably attached thereto for adjustment relative to said post;

said clamps include moveable adjustment elements adapted to tighten said clamps against said post;

whereby placement of said shelf in a desired position relative to said post and adjusting said elements to tighten said clamps in association with said angle frame serves to tightly mount said table to said post.

7. The shelf of claim 6, including said support rib and said angle frame, comprises one integrated piece molded of a thermoplastic resin.

8. The shelf of claim 7, wherein said adjustment elements comprise threaded bolts with heads; said angle frame includes slots arranged to permit the passage of said bolts therethrough; said clamps include captive holders for the heads of said bolts;

further including locking knobs adapted to engage said bolts;

whereby turning of said locking knobs serves to tighten or loosen said clamps in a position against said post.

9. The shelf of claim 6, wherein the flat upper surface of said shelf includes a hole for holding an article.

10. The shelf of claim 6, wherein the flat upper surface of said shelf includes a groove for retaining an article.

11. The device of claim 6, wherein said shelf includes multiple support ribs located at said shelf underside and extending along said shelf underside toward one end of said shelf;

said ribs and said shelf forming at said one end an angle frame;

said shelf and said multiple support ribs being of one integrated piece molded to also include said angle frame.

12. The device of claim 6 further including protective pads attached to said clamps and said angle frame for preventing damage to said post.

13. A shelf of the type adapted to be removably attached to a support so as to hold items thereon, the improvement comprising:

said shelf having an upper surface and an underside;

said shelf further including at one end thereof an angle frame integrally molded therewith;

said angle frame further including clamps slidably attached thereto for adjustment relative to said post;

said clamps include moveable adjustment elements adapted to tighten said clamps in position against said support;

whereby placement of said shelf in a desired position relative to said support and adjusting said elements to tighten said clamps in association with said angle frame serves to tightly mount said table to said support.

14. The shelf of claim 13, including said support rib and said angle frame, comprises one integrated piece molded of a thermoplastic resin.

15. The shelf of claim 13, wherein said adjustment elements comprise threaded bolts with heads;

said angle frame includes slots arranged to permit the passage of said bolts therethrough;

said clamps include captive holders for the heads of said bolts;

further including locking knobs adapted to engage said bolts;

whereby turning of said locking knobs serves to tighten or loosen said clamps in a position against said support.

16. The shelf of claim 13, wherein the flat upper surface of said shelf includes a hole for holding an item.

17. The shelf of claim 13, wherein the flat upper surface of said shelf includes a groove for retaining an item.

18. The device of claim 13, wherein said shelf includes multiple support ribs located at said shelf underside and extending along said shelf underside toward one end of said shelf;

said ribs and said shelf forming at said one end an angle frame;

said shelf and said multiple support ribs being of one integrated piece molded to also include said angle frame.

19. The device of claim 13 further including protective pads attached to said clamps and said angle frame for preventing damage to said support.

20. The device of claim 13 wherein said support is a bedpost.

* * * * *